US008955438B2

(12) United States Patent
Kitakami

(10) Patent No.: US 8,955,438 B2
(45) Date of Patent: Feb. 17, 2015

(54) PRINTING DEVICE AND PRINTING METHOD

(75) Inventor: Koichi Kitakami, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1127 days.

(21) Appl. No.: 12/949,540

(22) Filed: Nov. 18, 2010

(65) Prior Publication Data

US 2011/0139025 A1 Jun. 16, 2011

(30) Foreign Application Priority Data

Dec. 10, 2009 (JP) ..... 2009-280996

(51) Int. Cl.

| | |
|---|---|
| ***B41M 1/00*** | (2006.01) |
| ***G03G 15/00*** | (2006.01) |
| ***B41C 1/10*** | (2006.01) |
| ***G03G 15/16*** | (2006.01) |
| ***G03G 15/22*** | (2006.01) |

(52) U.S. Cl.

CPC ..... *B41M 1/00* (2013.01); *B41C 1/1058* (2013.01); *B41C 1/1066* (2013.01); *G03G 15/1625* (2013.01); *G03G 15/228* (2013.01)

USPC ..... 101/478; 101/483; 101/395

(58) Field of Classification Search

None

See application file for complete search history.

(56) References Cited

U.S. PATENT DOCUMENTS 4,718,340 A * 1/1988 Love, III ..... 101/116

FOREIGN PATENT DOCUMENTS

JP 10-250027 A 9/1998
JP 11-291603 A 10/1999

* cited by examiner

*Primary Examiner* — Joshua D Zimmerman

(74) *Attorney, Agent, or Firm* — Canon USA Inc. IP Division

(57) ABSTRACT

A printing device employing a rewritable plate, includes: a first plate forming member forming a rewritable plate; a latent image forming unit as to the first plate forming member; a protrusion forming unit selectively adhering an ink-repellent particle to a portion where a latent image on the surface of the first plate forming member is formed; a second plate forming member accepting and holding the ink-repellent particle adhered onto the surface of the first plate forming member using a hollow included in the surface; a pressure adhesion unit configured to push the ink-repellent particle adhered into the hollow; and a recording material supply unit supplying a recording material to the surface of the second plate forming member; with the surface of the ink-repellent particle having a property of repelling the recording material, and also the surfaces of the plate forming members having a property not to repel the recording material.

10 Claims, 6 Drawing Sheets

PRINTING DEVICE AND PRINTING METHOD

BACKGROUND OF THE INVENTION

1. Field of the Invention

The present invention relates to an on-demand offset printing device and printing method.

2. Description of the Related Art

Heretofore, a great number of printers employing an electrophotography system such as laser-beam printers, LED (light-emitting diode) printers, and so forth have been proposed. These printers have become widespread as on-demand printing applications. On the other hand, the planographic offset-printing method has been employed from ancient times as a productive application of a great amount of printed matter such as 1000 copies or more of printed matter having the same content, by using a plate.

Though improvement in image quality of printers employing the recent electrophotography system is remarkable, with printing wherein all over space is printed with one color, poor color uniformity (great color difference), curling, and so forth may occur. Also, printing as to thin paper such as with newspaper printing has not been realized.

On the other hand, the planographic offset-printing has become the mainstream of newspaper printing, and color printing has come to be able to be performed with thin paper, duplex, and high speed. Also, the planographic offset-printing has a principal feature in that the ink thickness on the printed matter is thin, such as 2 μm or so, so a printed matter can be finished without ruining the texture of paper.

However, with this printing, it takes time and cost for plate making, so a small number of output copies leads to increase in costs, and accordingly, this printing has not spread beyond a printing application of a great number of copies.

Therefore, there is demand for a new printing device in which the image quality of the planographic offset-printing method is obtained by on-demand while maintaining the simpleness of an electrophotography printer, and also realizing less cost and time even with a small number of output copies.

For example, with Japanese Patent Laid-Open No. 10-250027, a method for performing offset printing has been proposed wherein titanium oxide exhibiting hydrophobicity is formed on the surface of a latent image forming drum, and ultraviolet rays are irradiated on this according to the electronic data of an original to create a hydrophilic portion. Subsequently, after a "dampening solution" is held at this portion, ink is applied to the hydrophobic portion. Subsequently, the above hydrophilic portion returns to the original hydrophobicity by being heated to a predetermined temperature, and on-demand printing is enabled taking advantage of this process.

On the other hand, with Japanese Patent Laid-Open No. 11-291603, an on-demand relief printing method that does not employ this "dampening solution" has been proposed. First, an image is formed with ink-philic toner on the ink-repellent surface of a plate cylinder by the electrophotography method, and is temporarily fixed with heat. Subsequently, after ultraviolet cure waterless ink for offset is impressed on this toner, this ink image is hardened by being irradiated with ultraviolet rays, thereby forming a temporary "plate" which is firmer than the case of only a toner image. Waterless ink for planography is impressed on this plate again, and the ink thereof is transferred to a printing member (paper or the like). After ink supply and transfer operations are repeated a predetermined number of times, a toner image temporarily fixed on an object having the ink-repellent surface is removed along with an ink image left behind on the toner image, thereby enabling on-demand printing.

However, with the method disclosed in Japanese Patent Laid-Open No. 10-250027, unlike an offset plate having steps, a hydrophilic portion and a hydrophobic portion formed on a face having no steps are supplied with dampening solution and ink in an adhesion manner. Therefore, the edge (outline of a character or image) of ink which is a liquid is restrained only by dampening solution which is a liquid. As a result thereof, the edge of ink readily moves at the time of transferring ink to a blanket cylinder, and consequently, the outline of a character or image collapses from the original object to be formed, and printing quality is prevented from being kept in high quality, which is an issue.

Also, with the method disclosed in Japanese Patent Laid-Open No. 11-291603, ink to be printed is impressed on a protrusion made up of the temporarily fixed toner image (layer), and the layer where the ink impressed thereon is hardened by ultraviolet rays, and this ink is transferred to paper or the like. Therefore, the ink to be transferred to paper is put on the protrusion without any restraint from the surroundings, so the edge of the ink readily moves at the time of transferring the ink to paper. As a result thereof, the outline of a character or image collapses from the original object to be formed, and printing quality is prevented from being kept in high quality, which is an issue.

Also, a development process is passed through three processes of (1) Temporary fixing process by toner, (2) Application process of ink to be hardened as first coating, and (3) Application process of ink to be ultimately transferred to paper, so printing efficiency is poor, and there is room for improvement as to speeding up of printing speed.

SUMMARY OF THE INVENTION

The present invention has been proposed in light of the above situations, and provides a printing device and a printing method which are as simple as those of an electrophotography printer, but a "plate" is manufactured at high speed on-demand, and the edge (the outline of a character or image) of ink has high quality.

In order to solve the above issues, there is provided a printing device according to the present invention which is a printing device employing a rewritable plate, including: a first plate forming member configured to form a rewritable plate; a latent image forming unit configured to form a latent image on the surface of the first plate forming member; a protrusion forming unit configured to form a protrusion by selectively adhering an ink-repellent particle to a portion where the latent image on the surface of the first plate forming member; a second plate forming member configured to accept and hold the ink-repellent particle adhered onto the surface of the first plate forming member using a hollow included in the surface; a pressure adhesion unit configured to push the ink-repellent particle held on the second plate forming member into the hollow; a recording material supply unit configured to supply a recording material to the surface of the second plate forming member; an intermediate transfer member configured to transfer the recording material supplied to the surface of the second plate forming member; a pressing unit configured to press the recording material of the surface of the intermediate transfer member at the time of transferring to a recorded medium; and a conveying unit configured to convey the recorded medium; with the surface of the ink-repellent particle having a property of repelling the recording material, and also the surfaces of the plate forming members having a property not to repel the recording material.

Also, there is provided a printing method according to the present invention that is a printing method employing a rewritable plate, including: a first process arranged to form a latent image as to the surface of a first plate forming member configured to form a rewritable plate; a second process arranged to form a protrusion by adhering an ink-repellent particle to the surface of the first plate forming member based on the latent image; a third process arranged to accept and hold the ink-repellent particle on the surface of the first plate forming member in a hollow of the surface of a second plate forming member; a fourth process arranged to push the ink-repellent particle held by the second plate forming member into the hollow; a fifth process arranged to supply a recording material to the surfaces of the plate forming members to form an image portion; a sixth process arranged to transfer the recording material of the surfaces of the plate forming members to an intermediate transfer member; and a seventh process arranged to transfer the recording material of the surface of the intermediate transfer member to a recorded medium; with the surface of the ink-repellent particle having a property of repelling the recording material, and also the surfaces of the plate forming members having a property not to repel the recording material.

With the present invention, in a gap position between a plate cylinder which is a second plate forming member, and a particle pressure adhesion roller, an ink-repellent particle is pushed into a hollow of the plate cylinder surface by the particle pressure adhesion roller, and is firmly held by fitting force. At the same time, irregularity can be corrected by the hollow of the plate cylinder surface where multiple ink-repellent particles irregularly subjected to adhesion development within a latent image spot written into the first plate forming member are disposed with regularity. As a result thereof, high-quality printing can be realized. Also, with the present invention, employing ink-repellent particles eliminates the necessity of damping solution, whereby a printing method taking an environment into consideration can be provided.

Further features of the present invention will become apparent from the following description of exemplary embodiments with reference to the attached drawings.

DESCRIPTION OF THE EMBODIMENTS

Hereafter, embodiments of the present invention will be described with reference to the drawings.

First Embodiment

Figure 1:
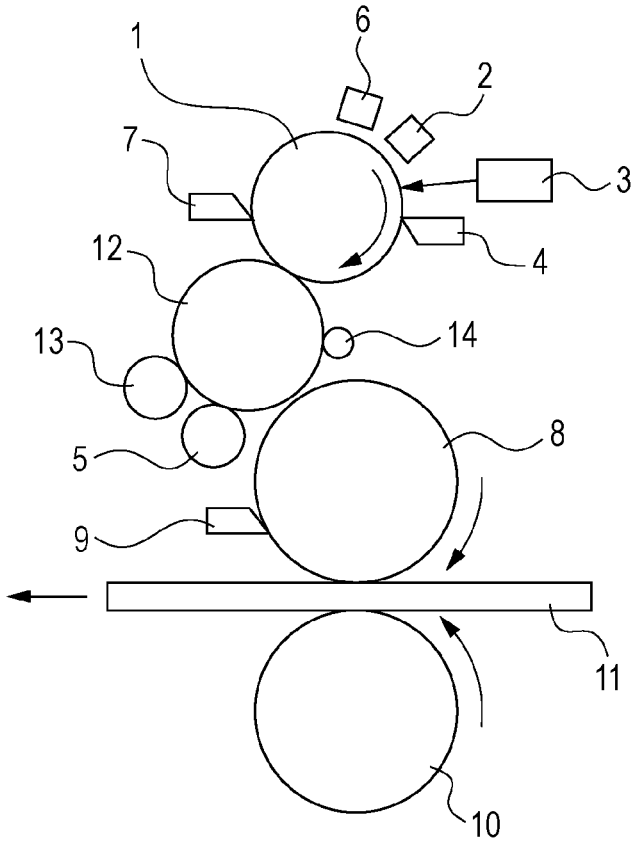
FIG. 1 is a diagram for describing the configuration of a first embodiment of the present invention.

Description will be made regarding a first embodiment of the present invention based on FIGS. 1 through 4C. A printing device according to the present embodiment includes a photosensitive drum 1 made up of an amorphous silicon photosensitive member (a-Si) which is a first plate forming member for forming a rewritable plate such as illustrated in FIG. 1. There are disposed a charger 2, an exposure device 3, a developing device 4, a plate cylinder 12, a discharge unit 6, and a first cleaner 7 around this photosensitive drum 1. The exposure device 3 is configured as a latent image forming unit for writing a latent image onto the surface of the photosensitive drum 1 serving as a first plate forming member. The developing device 4 is configured as a protrusion forming unit for forming a protrusion by selectively adhering an ink-repellent particle 20 on a portion where the latent image on the surface of the photosensitive drum 1 serving as the first plate forming member is formed. Further, the plate cylinder 12 serving as a second plate forming member transfers the ink-repellent particle 20 adhered on the surface of the photosensitive drum 1 serving as the first plate forming member to the surface of the plate cylinder 12 having a hollow 22, and also enhances holding force by pushing the ink-repellent particle 20 into the hollow 22 by a particle pressure adhesion roller 13. An ink roller 5 is configured as a recording material supply unit for supplying ink 21 serving as a recording material to the surface of the plate cylinder 12 serving as the second plate forming member. There is provided a blanket cylinder 8 serving as an intermediate transfer member for transferring the ink 21 serving as a recording material supplied to the surface of the plate cylinder 12 serving as the second plate forming member. Further, around this blanket cylinder 8 there are disposed a second cleaner 9, and an impression cylinder 10 serving as a pressing unit which presses at the time of transferring the ink 21 serving as the recording material of the surface of the blanket cylinder 8 to paper 11 serving as a recorded medium. The blanket cylinder 8 and the impression cylinder 10 also serve as a conveying unit for conveying the paper 11 serving as a recorded medium.

In response to a digital signal (image portion data is mirror image data) transmitted from an unshown host computer, the photosensitive drum 1, plate cylinder 12, ink roller 5, blanket cylinder 8 and impression cylinder 10 are rotated by being driven by an unshown motor as illustrated with an arrow in FIG. 1. Also, in response to this operation, the paper 11 serving as a recorded medium is conveyed between the blanket cylinder 8 and impression cylinder 10 by the unshown conveying unit.

With the first embodiment, oil-based ink (SAKATA INX CORP. sheet offset ink Diatone Ecopure SOY-HPJ) generally marketed was employed, and one belonging to the amorphous silicon system stably adaptable to ink including solvent was employed as the photosensitive drum 1. The surface (surface protecting layer) of the amorphous silicon photosensitive drum 1 is configured of an amorphous material with at least one of silicon and carbon as a parent body, and is ink-philic (has lipophilicity). With this surface protecting layer, a film is formed by the high-frequency plasma CVD (Chemical Vapor Deposition) method, or the PCVD (Plasma Chemical Vapor Deposition) method.

Figure 2A:
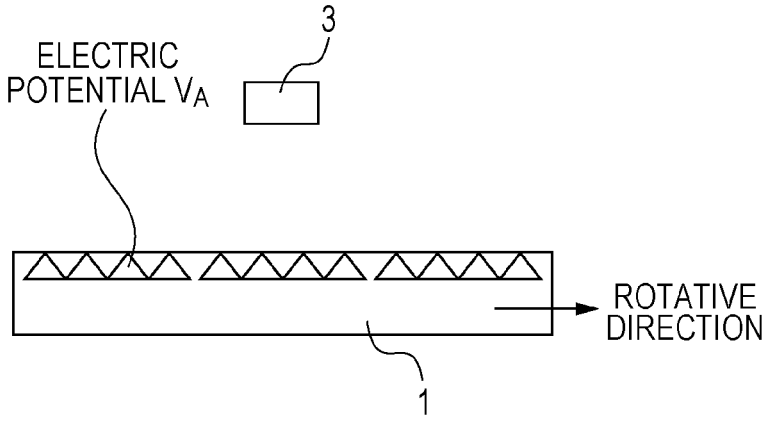
FIGS. 2A to 2C show diagrams for describing exposure and development processes according to the first embodiment of the present invention.
Figure 2B:
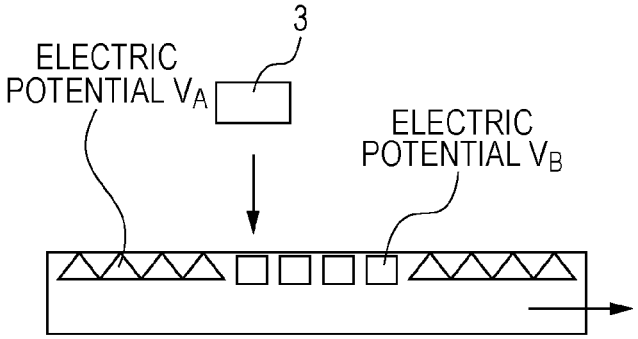

With regard to this photosensitive drum 1, the surface of the photosensitive drum 1 was charged to −600 V by the charger 2 (electric potential $V_A$ in FIG. 2A), and then an electrostatic latent image is written and formed in a position equivalent to a non-image portion by the exposure device 3 (electric potential $V_B$ in FIG. 2B). With the present embodiment, the electric potential $V_B$ was around −30 V.

Figure 2C:
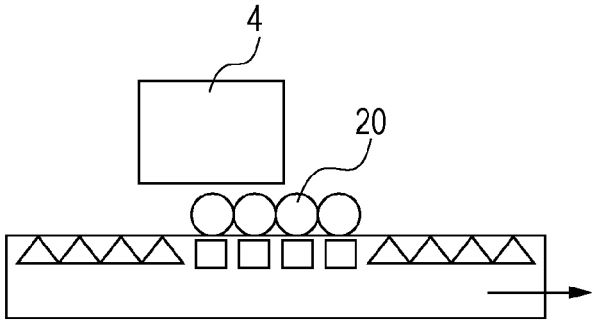

Next, with regard to this electrostatic latent image, the developing device 4 which stores the ink-repellent particle 20 negatively friction-charged is held at −400 V (electric potential $V_C$), and is adhered to the non-image portion (portion at −30 V) by reversal development (see FIG. 2C). The principle of adhesion of this ink-repellent particle 20 is based on "relationship between an electric field vector and a force vector", an electric field vector is formed toward the developing device 4 from the exposure face between the developing device 4 of −400 V and the exposure face of −30V. Accordingly, at the same time, the force vector affects in a direction where the ink-repellent particle 20 is drawn to the non-image portion (portion of −30 V) as to the ink-repellent particle 20 positioned between the developing device 4 and the non-image portion (portion of −30 V). On the other hand, an electric field vector is formed toward the face of −600 V from the developing device 4 between the face of −600 V which is not exposed and the developing device 4 of −400 V. At the same time, the force vector affects in a direction which keeps away the ink-repellent particle 20. This is an idea commonly employed at the development process of the electrophotography system.

Also, the ink-repellent particle 20 is adhered here by a contact developing method. The strength of adhering force of this ink-repellent particle 20 should be adjusted with a desired condition by controlling the potential difference of three of electric potentials $V_A$, $V_B$, and $V_C$ while maintaining the following Mathematical Expression 1 with the magnitude relation of the absolute values of the electric potentials in the event that all of $V_A$, $V_B$, and $V_C$ are negative electric potentials.

$$(\text{Absolute value of electric potential } V_A) > (\text{Absolute value of electric potential } V_C) > (\text{Absolute value of electric potential } V_B) \quad (1)$$

As for the ink-repellent particle 20 in the event of employing oil-based ink 21, a resin made up of a hydrophilic polymer can be employed, such as polyvinyl alcohol, polyvinyl pyrrolidone, polyacrylic acid, nylon, or cellulose. Alternatively, a hydrophobic oil-repellent resin made up of fluorine or silicon or the like can be employed as the ink-repellent particle 20. Also, commercially-available particles can be used as the ink-repellent particle 20. For example, there can be employed powder of polytetrafluoroethylene by DuPont-Mitsui Fluorochemicals, Inc. (Teflon (registered trademark) 7A), Polytetrafluoroethylene particles by Daikin Industries, LTD. (Leblond (registered trademark) L-5F), PFA particles by DuPont-Mitsui Fluorochemicals, Inc. (MP10), FEP particles by DuPont (5328000), or Silicon powder by DOW CORNING TORAY (Trefil (registered trademark) E-606). Also, this may be manufactured as follows. Specifically, (1) A desired resin is ground after being subjected to melt kneading, and is converted into particles by dispersion to a liquid, nebulization into a gas, or the like. (2) At the time of copolymerizing monomer corresponding to a desired resin, the resin is converted into particles at the same time. Further, an oleaginous component, magnetic substance, charge controlling agent, or the like may be made to internally or externally accompany the ink-repellent particles 20. In addition, examples of an additive to be mixed with the ink-repellent particle 20 include nonorganic fine particles, nonorganic fine particles and organic fine particles which have been subjected to surface processing. With the present embodiment, silica particles were added to the powder of polytetrafluoroethylene by DuPont-Mitsui Fluorochemicals, Inc. (Teflon (registered trademark) 7A) by 2 wt %, which were employed as the ink-repellent particles 20.

With offset printing, with regard to the thickness of the ink 21 to be ultimately transferred to the paper 11, 2 μm through 3 μm excels in image quality. Subsequently, the thickness of the ink 21 to be supplied to the surface of the plate cylinder 12 serving as the second plate forming member has to be thicker than 2 μm through 3 μm, so the weight average particle sizes of the ink-repellent particles 20 are preferably between 5 μm and 170 μm, more preferably between 5 μm and 20 μm, and further preferably between 5 μm and 10 μm.

As for the above exposure device 3, there was employed a device employing a method for scanning the laser from a semiconductor laser oscillator by rotation of a polygon mirror to form an electrostatic image on the photosensitive drum 1. A device employing a light source wherein LEDs (light-emitting diodes) are arrayed may be employed as the exposure device 3.

Figure 3A:
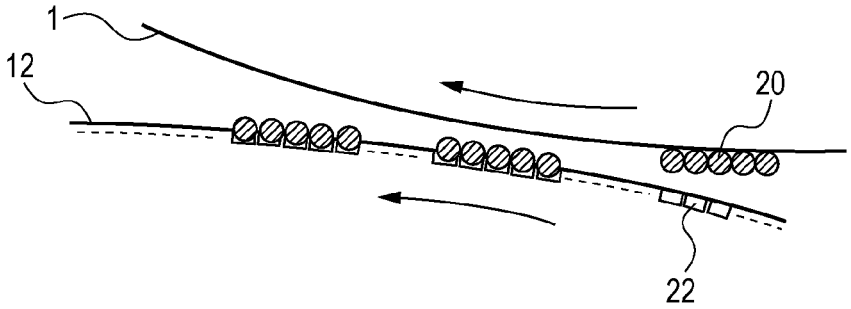
FIG. 3A is a diagram for describing an ink-repellent particle transfer process according to the first embodiment of the present invention.
Figure 3B:
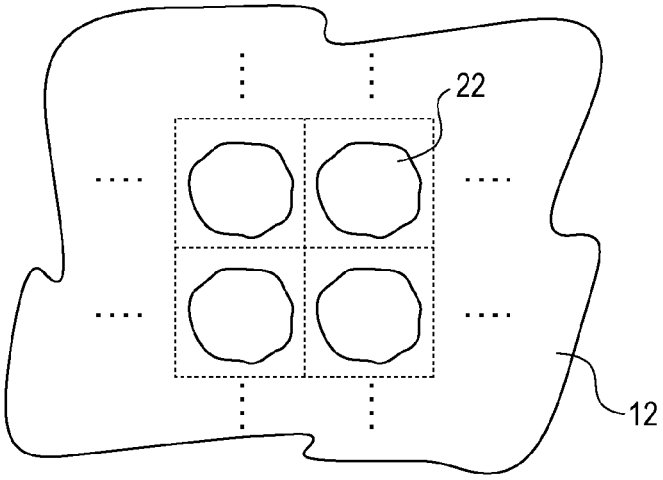
FIG. 3B is a diagram for describing a hollow on a plate cylinder surface.
Figure 3C:
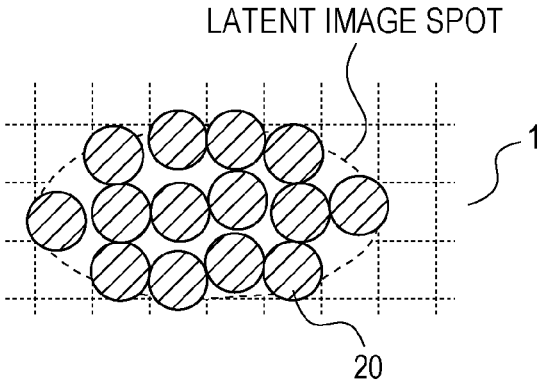
FIG. 3C is a diagram for describing ink-repellent particles positioned above a photosensitive drum.

Also, hollows 22 are formed on the surface of the plate cylinder 12 in the vertical and horizontal directions with an equal interval (FIG. 3B). With the present first embodiment, hollows 22 were fabricated on an aluminum plate with a 9-μm pitch (equivalent to 175 lines) by wet etching processing. The equivalent circle diameters of the hollows 22 were 5 μm or so. The aluminum plate thus processed was wound around the surface of the cylinder made from steel, which was employed as the plate cylinder 12. It goes without saying that the hollows 22 may directly be formed on the surface of the cylinder made from aluminum. Also, the weight average particle diameters of the ink-repellent particles 20 are 8 to 9 μm. It should be noted that the pitch of the hollows 22 fabricated on the aluminum plate, the equivalent circle diameters of the hollows 22, and the weight average particle diameters of the ink-repellent particles 20 described in the above are but an example. Each dimension may be configured by setting the pitch of the hollows 22, and the equivalent circle diameters of the hollows 22, which are adapted to the weight average particle diameters of the ink-repellent particles 20. The weight average particles of the ink-repellent particles 20 are preferably between 5 μm and 170 μm, and more preferably between 5 μm and 20 μm. The pitch of the hollows 22 fabricated on the aluminum plate is preferably between 5 μm and 170 μm, and further preferably between 5 μm and 20 μm. The equivalent circle diameters of the hollows 22 are preferably between 3 μm and 165 μm, and further preferably between 3 μm and 18 μm.

Next, the ink-repellent particles 20 are transferred to the plate cylinder 12 surface from the photosensitive drum 1 surface using the principle of a transfer charger. Specifically, first, the ink-repellent particles 20 negatively friction-charged adhered with the photosensitive drum 1 surface by mirror image force are transferred to the gap position with the plate cylinder 12. The plate cylinder 12 surface is kept in −5 V, the ink-repellent particles 20 are transferred to the plate cylinder 12 surface in the gap position between the photosensitive drum 1 and the plate cylinder 12 (FIG. 3A). This is also based on the "relationship between an electric field vector and a force vector", and an electric field vector is formed toward the photosensitive drum 1 surface from the plate cylinder 12 between the photosensitive drum 1 surface (exposure portion) of −30 V and the plate cylinder 12 of −5 V. Accordingly, at the same time, the force vector affects on the ink-repellent particle 20 positioned between the plate cylinder 12 and the photosensitive drum 1 surface (exposure portion) in a direction where the ink-repellent particle 20 is drawn to the plate cylinder 12 surface. The ink-repellent particle 20 transferred from the photosensitive drum 1 surface to the plate cylinder 12 surface is positioned in the hollow 22 of this plate cylinder 12 surface.

Figure 3D:
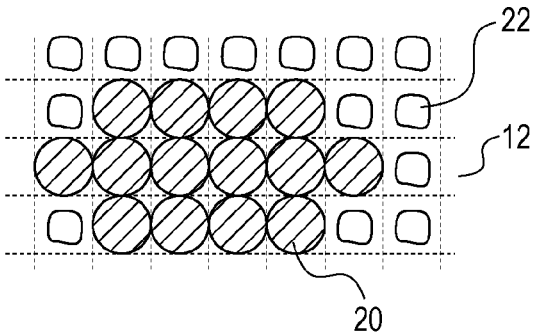
FIG. 3D is a diagram for describing ink-repellent particles positioned above a plate cylinder.

Subsequently, the ink-repellent particle 20 is pushed into the hollow 22 by the particle pressure adhesion roller 13 in the gap position between the plate cylinder 12 and the particle pressure adhesion roller 13, and is firmly held by fitting force. Thus, with regard to the multiple ink-repellent particles 20 (FIG. 3C) irregularly developed and adhered within a latent image spot written into the photosensitive drum 1 surface by the exposure device 3, the irregularity thereof can be corrected by the hollows 22 of the plate cylinder 12 surface disposed with regularity (FIG. 3D). As a result thereof, high-quality printing can be realized.

Next, the ink 21 is supplied onto the plate cylinder 12 by the ink roller 5. At this time, it is desired to rotate the ink roller 5 and the plate cylinder 12 in a state in which the speed difference in the circumferential direction in a contact position between the ink roller 5 and the plate cylinder 12 is generally zero.

As the ink roller 5 and the plate cylinder 12 rotate, a state is formed wherein the ink 21 layer adhered to the circumferential face of the ink roller 5 is pressed against the plate cylinder 12 adhered with the ink-repellent particle 20. Force acts between the surface of the ink 21 layer of the ink roller 5 surface thus pressed, and the ink-repellent particle 20 so as to exclude each other by ink-repellency (property of repelling ink). Accordingly, with a process wherein the ink roller 5 and the plate cylinder 12 further rotate to widen the gap in the radial direction, the surface of the ink 21 layer, and the ink-repellent particle 20 are separated by the repellent property (ink repellency).

On the other hand, the ink-philic plate cylinder 12 surface (region with no adhesion of ink-repellent particle 20) is wetted by the ink 21, which is thus adsorbed. Accordingly, with the process wherein the ink roller 5 and the plate cylinder 12 further rotate to widen the gap in the radial direction, a portion of the thickness of the ink 21 layer adhering to the circumferential face of the ink roller 5 is peeled off, and the ink 21 is held on the plate cylinder 12 surface (see FIG. 4B). This process is the same as with offset printing.

Specifically, with the present embodiment, the surface of the ink-repellent particle 20 fitted into the hollow 22 on the surface of the plate cylinder 12 serving as the second plate forming member by the developing device 4 serving as a protrusion forming unit has a property of repelling the ink 21 serving as a recording material. Also, the surface of the plate cylinder 12 has a property not to repel the ink 21. Particularly, with the present embodiment, let us say that the recording material is the oil-based ink 21, the surfaces of the ink-repellent particles 20 have oil repellency, and the surface of the plate cylinder 12 has lipophilicity.

The holding thickness of the ink 21 as to the plate cylinder 12 surface is controlled by an adjustment method commonly performed by offset printing, such as adjustment of "gap amount between the ink roller 5 and the plate cylinder 12", "thickness of the ink 21 layer of the ink roller 5 surface", and the like.

Subsequently, the ink 21 held on the plate cylinder 12 surface by the wettability, the ink-repellent particles 20 held by the fitting force of the hollows 22 of the plate cylinder 12 surface move to a contact position with the blanket cylinder 8. An ink-philic rubber material is wound around the surface of the blanket cylinder 8 in the same way as that for common offset printing.

Figure 4A:
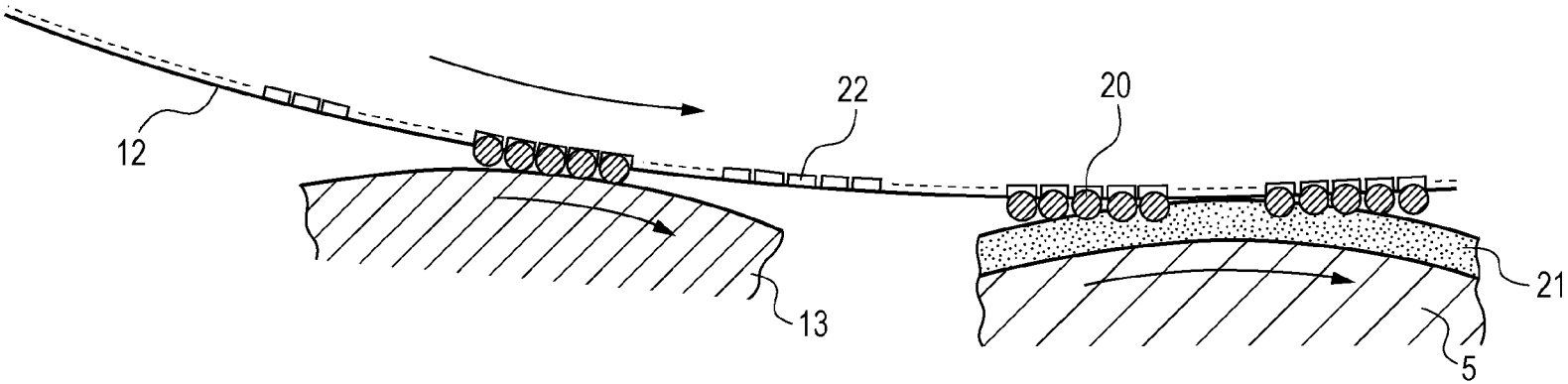
FIG. 4A is a diagram for describing an ink-repellent particle pressure adhesion process and an ink supply process according to the first embodiment of the present invention.
Figure 4C:
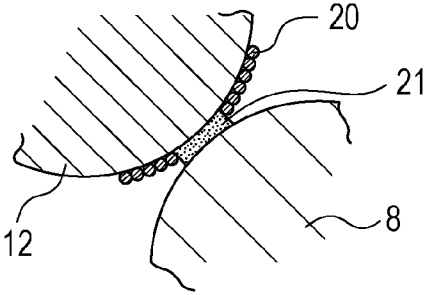
FIG. 4C is a diagram for describing transfer of ink on the plate cylinder to a blanket cylinder.
Figure 4B:
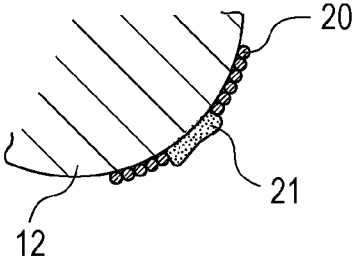
FIG. 4B is a diagram for describing ink-repellent particles and ink on the plate cylinder surface.

Only a portion of the thickness of the ink 21 layer supplied onto the plate cylinder 12 is intermediately transferred to the blanket cylinder 8 disposed with a desired gap being provided (see FIG. 4C). The transfer amount at this time (the thickness of the ink 21 layer) is controlled by an adjustment method commonly performed by offset printing, such as adjustment of "gap amount between the plate cylinder 12 and the blanket cylinder 8" or the like. It goes without saying that the transfer amount also relates to adjustment of the holding thickness of the ink 21 as to the plate cylinder 12 surface, so adjustment of "gap amount between the ink roller 5 and the plate cylinder 12", "thickness of the ink 21 layer of the ink roller 5 surface", or the like may be necessary.

The region on the photosensitive drum 1 of which the transfer process to the plate cylinder 12 has been completed moves to the position of the first cleaner 7. The first cleaner 7 is configured to do cleaning by a scraping operation by a blade made from rubber. Subsequently, the region on the photosensitive drum 1 moves to the position of the discharge unit 6, where the charge is removed.

Also, the region on the plate cylinder 12 of which the transfer process to the blanket cylinder 8 has been completed moves to the position of a third cleaner 14. The third cleaner 14 is configured to perform cleansing after the ink-repellent particles 20 and the ink 21 are collectively removed by a scraping operation by the blade made from rubber. Also, a drying unit may be disposed as appropriate after the cleaning process by the third cleaner 14.

The image by the ink 21 intermediately transferred to the blanket cylinder 8 is, as the final process, transferred to the paper 11 serving as a recorded medium sandwiched between the blanket cylinder 8 and the impression cylinder 10, and the printing ends. The region on the blanket cylinder 8 transferred to the paper 11 was restored to the initial state by removing the remaining ink by the second cleaner 9. Subsequently, by passing through the operation by the charger 2, and passing through the process to advance to the exposure device 3 again, on-demand digital offset printing is realized.

The above description is based on printing using, for example, one color of black ink for the sake of simplicity, but the Inventor was able to perform full color printing by disposing the device having the configuration in FIG. 1 as to the ink 21 such as cyan, magenta, yellow, or the like.

The printing method according to the present embodiment is a printing method employing a rewritable plate, and includes a first process wherein a latent image is written onto the surface of the photosensitive drum 1 serving as the first plate forming member forming a rewritable plate, and a second process wherein the surface of the photosensitive drum 1 is adhered with the ink-repellent particles 20 based on the latent image to form a protrusion. The printing method according to the present embodiment further includes a third process wherein the ink-repellent particles 20 on the photosensitive drum 1 are accepted and held by the hollows 22 of the plate cylinder 12 serving as the second plate forming member, and a fourth process wherein the ink-repellent particles 20 held on the plate cylinder 12 are pushed into the hollows 22. The printing method according to the present embodiment further includes a fifth process wherein the ink 21 is supplied to the surface of the photosensitive drum 1 to form an image portion, and a sixth process wherein the ink 21 of the surface of the photosensitive drum 1 is transferred to the blanket cylinder 8 serving as an intermediate transfer member. The printing method according to the present embodiment further includes a seventh process wherein the ink 21 of the surface of this blanket cylinder 8 is transferred to the paper 11 serving as a recorded medium. The surfaces of the ink-repellent particles 20 are configured to have a property of repelling the ink 21, and also the surface of the photosensitive drum 1 is configured not to repel the ink 21.

Also, at the time of outputting printed matter having the same content, after the ink-repellent particles 20 were installed on the plate cylinder 12 surface, printing was performed through a step to separate the photosensitive drum 1, a unit configured to be disposed on the periphery thereof, and the third cleaner 14 from the plate cylinder 12, whereby printing could performed at high speed.

Second Embodiment

With the first embodiment, as a method for transferring the ink-repellent particles 20 from the surface of the photosensitive drum 1 serving as the first plate forming member to the surface of the plate cylinder 12 serving as the second plate forming member, the principle of a transfer charger was used. On the other hand, the present embodiment is an example in the event of transferring the ink-repellent particles 20 by being fitted into the hollows 22 of the plate cylinder 12 surface by adjusting the gap amount between the photosensitive drum 1 serving as the first plate forming member and the plate cylinder 12 serving as the second plate forming member, and the diameters of the ink-repellent particles 20.

The following description is generally the same as with the first embodiment described with reference to FIG. 1 through FIG. 4C, and the same portions will be omitted.

With regard to the photosensitive drum 1, the surface of the photosensitive drum 1 was charged to −600 V by the charger 2, and then an electrostatic latent image was formed by having been written into a position equivalent to a non-image portion by the exposure device 3. With the present embodiment, the electric potential $V_B$ was −30 V or so.

Next, with regard to this electrostatic latent image, the developing device 4 which stores the ink-repellent particles 20 negatively friction-charged was held at −400 V, and the non-image portion (portion of −30 V) was adhered with this electrostatic image by reversal development. Also, the ink-repellent particles 20 were adhered here by the contact development method.

With the present embodiment, silica particles were added to the powder of polytetrafluoroethylene by DuPont-Mitsui Fluorochemicals, Inc. (Teflon (registered trademark) 7A) by 2 wt %, which were employed as the ink-repellent particles 20. The weight average particle diameters of the ink-repellent particles 20 are preferably 5 μm or more.

As for the above exposure device 3, a device employing a method for scanning the laser from a semiconductor laser oscillator by rotation of a polygon mirror to form an electrostatic image on the photosensitive drum 1 was used. A device employing a light source wherein LEDs (light-emitting diodes) are arrayed may be employed as the exposure device 3.

Also, hollows 22 are formed on the surface of the plate cylinder 12 in the vertical and horizontal directions with an equal interval. With the present second embodiment, hollows 22 were fabricated on an aluminum plate with a 9-μm pitch (equivalent to 175 lines) by wet etching processing. The equivalent circle diameters of the hollows 22 were 5 μm or so. The aluminum plate thus processed was wound around the surface of the cylinder made from steel, which was employed as the plate cylinder 12. It goes without saying that the hollows 22 may directly be formed on the surface of the cylinder made from aluminum. Also, the weight average particle diameters of the ink-repellent particles 20 are 8 to 9 μm. It should be noted that the pitch of the hollows 22 fabricated on the aluminum plate, the equivalent circle diameters of the hollows 22, and the weight average particle diameters of the ink-repellent particles 20 described in the above are but an example. Each dimension may be configured by setting the pitch of the hollows 22, and the equivalent circle diameters of the hollows 22, which are adapted to the weight average particle diameters of the ink-repellent particles 20. The weight average particles of the ink-repellent particles 20 are preferably between 5 μm and 170 μm, and more preferably between 5 μm and 20 μm. The pitch of the hollows 22 fabricated on the aluminum plate is preferably between 5 μm and 170 μm, and further preferably between 5 μm and 20 μm. The equivalent circle diameters of the hollows 22 are preferably between 3 μm and 165 μm, and further preferably between 3 μm and 18 μm.

The ink-repellent particles 20 pushed into the hollows 22 from the photosensitive drum 1 surface to the plate cylinder 12 surface are transferred and positioned in the hollows 22 of the plate cylinder 12 surface by setting the fitting force with the hollows 22 to be superior to the adhesion force due to mirror image force. Also, with the present second embodiment, the gap amount between the photosensitive drum 1 and the plate cylinder 12 is arranged to be smaller as compared to the first embodiment, whereby the ink-repellent particles 20 are pushed into the hollows 22 of the plate cylinder 12 surface from the photosensitive drum 1.

Subsequently, the ink-repellent particles 20 are pushed into the hollows 22 in the gap position between the plate cylinder 12 and the particle pressure adhesion roller 13 by the particle pressure adhesion roller 13, and are firmly held by fitting force. Thus, with regard to the multiple ink-repellent particles 20 irregularly developed and adhered within a latent image spot written into the photosensitive drum 1 surface by the exposure device 3, the irregularity thereof can be corrected by the hollows 22 of the plate cylinder 12 surface disposed with regularity. As a result thereof, high-quality printing can be realized.

Next, the ink 21 is supplied onto the plate cylinder 12 by the ink roller 5. At this time, it is desired to rotate the ink roller 5 and the plate cylinder 12 in a state in which the speed difference in the circumferential direction in a contact position between the ink roller 5 and the plate cylinder 12 is generally zero.

As the ink roller 5 and the plate cylinder 12 rotate, a state is formed wherein the ink 21 layer adhered to the circumferential face of the ink roller 5 is pressed against the plate cylinder 12 adhered with the ink-repellent particle 20. Force acts between the surface of the ink 21 layer of the ink roller 5 surface thus pressed, and the ink-repellent particle 20, so as to exclude each other by ink-repellency (property of repelling ink). Accordingly, with a process wherein the ink roller 5 and the plate cylinder 12 further rotate to widen the gap in the radial direction, the surface of the ink 21 layer, and the ink-repellent particle 20 are separated by the repellent property (ink-repellency).

On the other hand, the ink-philic plate cylinder 12 surface (region adhered with no ink-repellent particle 20) is wetted with the ink 21 which is adsorbed. Accordingly, with the process wherein the ink roller 5 and the plate cylinder 12 further rotate to widen the gap in the radial direction, a portion of the thickness of the ink 21 layer adhered with the circumferential face of the ink roller 5 peels off, and the ink 21 is held on the plate cylinder 12 surface. This process is the same as with offset printing.

Specifically, with the present embodiment, the surface of the ink-repellent particle 20 fitted into the hollow 22 on the surface of the plate cylinder 12 serving as the second plate forming member by the developing device 4 serving as a protrusion forming unit has a property of repelling the ink 21 serving as a recording material. Subsequently, the surface of the plate cylinder 12 has a property not to repel the ink 21. Particularly, with the present embodiment, let us say that the recording material is the oil-based ink 21, the surfaces of the ink-repellent particles 20 have oil repellency, and the surface of the plate cylinder 12 has lipophilicity.

The holding thickness of the ink 21 as to the plate cylinder 12 surface is controlled by an adjustment method commonly performed by offset printing, such as adjustment of "gap amount between the ink roller 5 and the plate cylinder 12", "thickness of the ink 21 layer of the ink roller 5 surface", or the like.

Subsequently, the ink 21 held on the plate cylinder 12 surface by the wettability, the ink-repellent particles 20 held by the fitting force of the hollows 22 of the plate cylinder 12 surface move to a contact position with the blanket cylinder 8. An ink-philic rubber material is wound around the surface of the blanket cylinder 8 in the same way as that for common offset printing.

Only a portion of the thickness of the ink 21 layer supplied onto the plate cylinder 12 is intermediately transferred to the blanket cylinder 8 disposed with a desired gap being provided. The transfer amount at this time (the thickness of the ink 21 layer) is controlled by an adjustment method commonly performed by offset printing, such as adjustment of "gap amount between the plate cylinder 12 and the blanket cylinder 8" or the like. It goes without saying that the transfer amount also relates to adjustment of the holding thickness of the ink 21 as to the plate cylinder 12 surface, so adjustment of "gap amount between the ink roller 5 and the plate cylinder 12", "thickness of the ink 21 layer of the ink roller 5 surface", or the like may be necessary.

The region on the photosensitive drum 1 of which the transfer process to the plate cylinder 12 has been completed moves to the position of the first cleaner 7. The first cleaner 7 is configured to do cleaning by scraping operation by a blade made from rubber. Subsequently, the region on the photosensitive drum 1 moves to the position of the discharge unit 6, where the charge is removed.

Also, the region on the plate cylinder 12 of which the transfer process to the blanket cylinder 8 has been completed moves to the position of a third cleaner 14. The third cleaner 14 is configured to perform cleansing after the ink-repellent particles 20 and the ink 21 are collectively removed by scraping operation by the blade made from rubber. Also, a drying unit may be disposed as appropriate after the cleaning process by the third cleaner 14.

The image by the ink 21 intermediately transferred to the blanket cylinder 8 is, as the final process, transferred to the paper 11 serving as a recorded medium sandwiched between the blanket cylinder 8 and the impression cylinder 10, and the printing ends. The region on the blanket cylinder 8 transferred to the paper 11 is restored to the initial state by removing the remaining ink by the second cleaner 9. Subsequently, by passing through the operation by the charger 2, and passing through the process to advance to the exposure device 3 again, on-demand digital offset printing is realized.

The above description is based on printing using, for example, one color of black ink for the sake of simplicity, but the Inventor was able to perform full color printing by disposing the device having the configuration in FIG. 1 as to the ink 21 such as cyan, magenta, yellow, or the like.

Also, at the time of outputting printed matter having the same content, after the ink-repellent particles 20 are installed on the plate cylinder 12 surface, printing is performed through a step to separate the photosensitive drum 1, a unit configured to be disposed on the periphery thereof, and the third cleaner 14 from the plate cylinder 12, whereby printing can be performed at high speed.

Third Embodiment

With the first and second embodiments, an example has been illustrated wherein the photosensitive drum 1 is employed as the first plate forming member. On the other hand, with the present embodiment, an adhesive drum 41 is employed as the first plate forming member. This is an example of a case where a latent image is written into the adhesive drum 41 surface serving as the first plate forming member by an adhesive agent using a dispenser 42 as a latent image forming unit.

Figure 5:
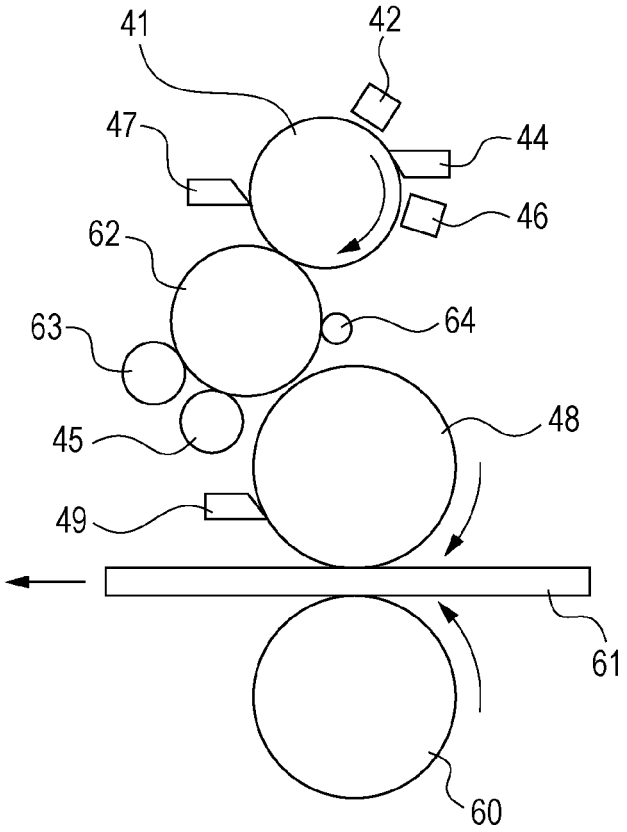
FIG. 5 is a diagram for describing the configuration of a third embodiment of the present invention.

The present embodiment will be described with reference to FIGS. 5 and 6. A printing device according to the present embodiment includes, as illustrated in FIG. 5, the adhesive drum 41 serving as the first plate forming member, and there are disposed around here the dispenser 42 serving as a latent image forming unit, a developing device 44 serving as a protrusion forming unit, a dry nozzle 46, and a first cleaner 47. The printing device according to the present embodiment further includes a plate cylinder 62 serving as the second plate forming member, and there are disposed around here a particle pressure adhesion roller 63 for enhancing fitting force by pushing the ink-repellent particles 20 into, an ink roller 45 serving as a recording material supply unit, and a third cleaner 64. A second cleaner 49 and an impression cylinder 60 serving as a pressing unit are disposed around a blanket cylinder 48 serving as an intermediate transfer member.

In response to a digital signal transmitted from an unshown host computer, the adhesive drum 41, ink roller 45, blanket cylinder 48, and impression cylinder 40 are rotated by being driven by an unshown motor as illustrated with an arrow in FIG. 5. Also, in response to this operation, a recorded medium such as the paper 11 or the like is conveyed by an unshown conveying unit for conveying the paper 11 serving as a recorded medium.

With the present embodiment, water-based ink (NSG-T type by FUJI INK MANUFACTURING CO., LTD.) 21 generally marketed was employed, and the surface of the adhesive drum 41 was coated by hydrophilic polyvinyl alcohol. In addition to polyvinyl alcohol, the surface of the adhesive drum 41 may be coated by a material made up of a hydrophilic high polymer such as polyvinyl pyrrolidone, polyacrylic acid, cellulose, nylon, or the like. With regard to the coat surface, hydrophilicity may be improved by forming multiple holes or minute rugged faces.

Figure 6A:
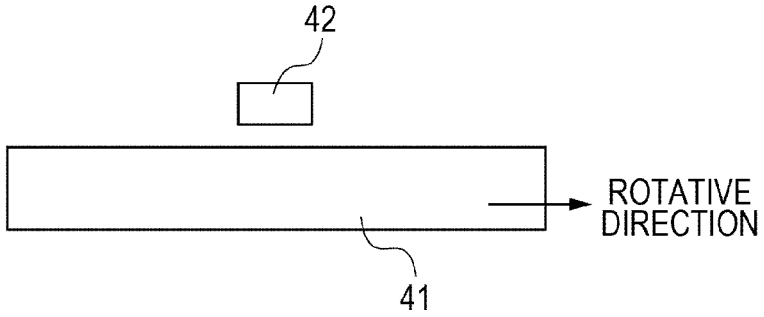
FIGS. 6A to 6C show diagrams for describing a development process according to the third embodiment of the present invention.
Figure 6B:
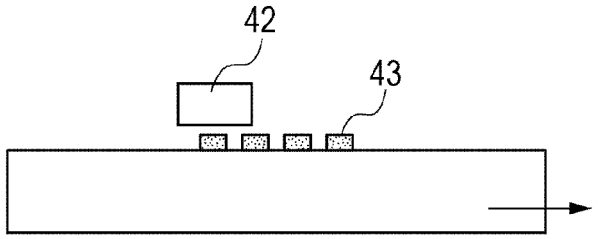
Figure 6C:
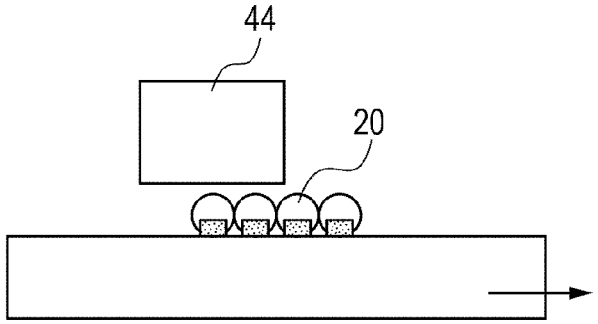

As to the adhesive drum 41, as illustrated in FIGS. 6A and 6B, a latent image was formed by dot-supplying a silicone series adhesive agent to a surface equivalent to a non-image portion of the adhesive drum 41 using the dispenser (ACCURA9 of Iwashita Engineering, Inc.) 42. In addition, a resin series adhesive agent of epoxy series, rubber series, or urethane series may be employed as the adhesive agent 43 to be supplied. Next, as illustrated in FIG. 6C, the ink-repellent particles 20 stored in the developing device 44 is adhered to this adhesive agent latent image by adhesive force. No ink-repellent particle 20 is adhered to a portion including no adhesive latent image. Subsequently, drying and hardening of the adhesive agent 43 are promoted by the dry nozzle 46 to improve the holding force of the ink-repellent particles 20. Also, in the event that the ink-repellent particles 20 supplied onto the adhesive drum 41 surface are layered double or triple, providing air blower is effective for converting the ink-repellent particles 20 into a single layer.

The ink-repellent particles 20 surfaces in the event of employing the water-based ink 21 were subjected to water-repellent processing using fluorine, silicon, or the like so as to have water-repellency.

In the event of offset printing, with regard to the thickness of the ink 21 to be ultimately transferred to the paper 11, 2 μm through 3 μm excel in image quality. Subsequently, the thickness of the ink 21 to be supplied to the surface of the adhesive drum 41 serving as the first plate forming member has to be thicker than 2 μm through 3 μm, so the weight average particle sizes of the ink-repellent particles 20 are preferably 5 μm or more.

Next, the ink-repellent particles 20 adhered to the adhesive drum 41 surface by adhesive force are moved to the gap position with the plate cylinder 12.

Also, hollows 22 are formed on the plate cylinder 62 surface in the vertical and horizontal directions with an equal interval. With the present third embodiment, hollows 22 were fabricated on an aluminum plate with a 9-μm pitch (equivalent to 175 lines) by wet etching processing. The equivalent circle diameters of the hollows 22 were 5 μm or so. The aluminum plate thus processed was wound around the surface of the cylinder made from steel, which was employed as the plate cylinder 62. It goes without saying that the hollows 22 may directly be formed on the surface of the cylinder made from aluminum. The aluminum plate also exhibits hydrophilic performance, so water-based ink may be employed. Also, the weight average particle diameters of the ink-repellent particles 20 are 8 to 9 μm. It should be noted that the pitch of the hollows 22 fabricated on the aluminum plate, the equivalent circle diameters of the hollows 22, and the weight average particle diameters of the ink-repellent particles 20 described in the above are but an example. Each dimension may be configured by setting the pitch of the hollows 22, and the equivalent circle diameters of the hollows 22, which are adapted to the weight average particle diameters of the ink-repellent particles 20. The weight average particles of the ink-repellent particles 20 are preferably between 5 μm and 170 μm, and more preferably between 5 μm and 20 μm. The pitch of the hollows 22 fabricated on the aluminum plate is preferably between 5 μm and 170 μm, and further preferably between 5 μm and 20 μm. The equivalent circle diameters of the hollows 22 are preferably between 3 μm and 165 μm, and further preferably between 3 μm and 18 μm.

The ink-repellent particles 20 pushed into the hollows 22 from the adhesive drum 41 surface to the plate cylinder 12 surface are transferred and positioned in the hollows 22 of the plate cylinder 12 surface by setting the fitting force with the hollows 22 to be superior to the adhesion force by the adhesive agent 43. Subsequently, the ink-repellent particles 20 are pushed into the hollows 22 in the gap position between the plate cylinder 12 and the particle pressure adhesion roller 13 by the particle pressure adhesion roller 13, and are firmly held by further strong fitting force. Thus, with regard to the multiple ink-repellent particles 20 irregularly developed and adhered within a latent image spot written into the adhesive drum 41 surface by the dispenser 42, the irregularity thereof can be corrected by the hollows 22 of the plate cylinder 12 surface disposed with regularity.

Next, the ink 21 is supplied onto the plate cylinder 62 by the ink roller 45. At this time, it is desired to rotate the ink roller 45 and the plate cylinder 62 in a state in which the speed difference in the circumferential direction in a contact position between the ink roller 45 and the plate cylinder 62 is generally zero.

As the ink roller 45 and the plate cylinder 62 rotate, a state is formed wherein the ink 21 layer adhered to the circumferential face of the ink roller 45 is pressed against the plate cylinder 62 adhered with the ink-repellent particles 20. Force acts between the surface of the ink 21 layer of the ink roller 45 surface thus pressed, and the ink-repellent particles 20, so as to exclude each other by ink-repellency (property of repelling ink). Accordingly, with a process wherein the ink roller 45 and the plate cylinder 62 further rotate to widen the gap in the radial direction, the surface of the ink 21 layer, and the ink-repellent particles 20 are separated by the repellent property (ink-repellency).

On the other hand, the ink-philic plate cylinder 62 surface (region adhered with no ink-repellent particle 20) is wetted by the ink 21 which is adsorbed. Accordingly, with the process wherein the ink roller 45 and the plate cylinder 62 further rotate to widen the gap in the radial direction, a portion of the thickness of the ink 21 layer adhered with the circumferential face of the ink roller 45 is peeled off, and the ink 21 is held on the plate cylinder 62 surface. This process is the same as with offset printing.

Specifically, with the present embodiment, the surfaces of the ink-repellent particles 20 fitted into the hollows 22 on the surface of the plate cylinder 62 serving as the second plate forming member by the developing device 44 serving as a protrusion forming unit has a property of repelling the ink 21 serving as a recording material. Subsequently, the surface of the plate cylinder 62 has a property not to repel the ink 21. Particularly, with the present embodiment, let us say that the recording material is the water-based ink 21, the surfaces of the ink-repellent particles 20 have water repellency, and the surface of the plate cylinder 62 has hydrophilicity.

The holding thickness of the ink 21 as to the plate cylinder 62 surface is controlled by an adjustment method commonly performed by offset printing, such as adjustment of "gap amount between the ink roller 45 and the plate cylinder 62", "thickness of the ink 21 layer of the ink roller 45 surface", or the like.

Subsequently, the ink 21 held on the plate cylinder 62 surface by wettability, and the ink-repellent particles 20 held by the fitting force of the hollows 22 of the plate cylinder 62 surface move to a contact position with the blanket cylinder 48. An ink-philic rubber material is wound around the surface of the blanket cylinder 48 in the same way as that for common offset printing.

Only a portion of the thickness of the ink 21 layer supplied onto the plate cylinder 62 is intermediately transferred to the blanket cylinder 48 disposed with a desired gap being provided. The transfer amount at this time (the thickness of the ink 21 layer) is controlled by an adjustment method commonly performed by offset printing, such as adjustment of "gap amount between the plate cylinder 62 and the blanket cylinder 48" or the like. It goes without saying that the transfer amount also relates to adjustment of the holding thickness of the ink 21 as to the plate cylinder 12 surface, so adjustment of "gap amount between the ink roller 45 and the plate cylinder 62", "thickness of the ink 21 layer of the ink roller 45 surface", or the like may be necessary.

The region on the photosensitive drum 41 of which the transfer process to the plate cylinder 62 has been completed moves to the position of the first cleaner 47. The first cleaner 47 is configured to remove the adhesive agent 43 by a scraping operation by a blade made from rubber.

Also, the region on the plate cylinder 62 of which the transfer process to the blanket cylinder 48 has been completed moves to the position of a third cleaner 64. The third cleaner 64 is configured to perform cleansing after the ink-repellent particles 20 and the ink 21 are collectively removed through scraping operation by the blade made from rubber. Also, a drying unit may be disposed as appropriate after the cleaning process by the third cleaner 64.

The image by the ink 21 intermediately transferred to the blanket cylinder 48 is, as the final process, transferred to the paper serving as a recorded medium 61 sandwiched between the blanket cylinder 48 and the impression cylinder 60, and the printing ends. The region on the blanket cylinder 48 transferred to the recorded medium 61 is restored to the initial state by removing the remaining ink by the second cleaner 49. Subsequently, by advancing to the latent image forming process by the adhesive agent 43 by the dispenser 42 again, on-demand digital offset printing is realized.

The above description is based on printing using, for example, one color of black ink for the sake of simplicity, but the Inventor was able to perform full color printing by disposing the device having the configuration in FIG. 1 as to the ink 21 such as cyan, magenta, yellow, or the like.

Also, at the time of outputting printed matter having the same content, after the ink-repellent particles 20 were installed on the plate cylinder 62 surface, printing was performed through a step to separate the adhesive drum 41, a unit configured to be disposed on the periphery thereof, and the third cleaner 64 from the plate cylinder 62, whereby printing could be performed at high speed.

Also, in some cases, with a part of technology fields, even if there were ink which is classified into neither "oil-based" nor "water-based", the above ink-repellent particles 20 is assumed to have a property of repelling the ink thereof. Subsequently, the second plate forming member surface such as the plate cylinders 12 and 62 and the like is assumed to have a property not to repel the ink thereof. An embodiment taking advantage of the property thereof is encompassed in the present invention.

The present invention can be applied to an on-demand offset printing device and printing method, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-280996 filed Dec. 10, 2009, which is hereby incorporated by reference herein in its entirety.

What is claimed is:

1. A printing device employing a rewritable plate, comprising:

a first plate forming member configured to form a rewritable plate;

a second plate forming member configured to accept and hold an ink-repellent particle adhered onto the surface of said first plate forming member using a hollow included in the surface;

a pressure adhesion unit configured to push said ink-repellent particle held on said second plate forming member into said hollow;

a recording material supply unit configured to supply a recording material to the surface of said second plate forming member;

an intermediate transfer member configured to transfer said recording material supplied to the surface of said second plate forming member;

a pressing unit configured to press said recording material of the surface of said intermediate transfer member at the time of transferring to a recorded medium; and a conveying unit configured to convey said recorded medium;

wherein the surface of said ink-repellent particle has a property of repelling said recording material, and also the surfaces of said plate forming members have a property not to repel said recording material.

2. The printing device according to claim 1, wherein said recording material is oil-based ink, the surface of said ink-repellent particle has oil repellency, and the surfaces of said plate forming members have lipophilicity.

3. The printing device according to claim 1, wherein said recording material is water-based ink, the surface of said ink-repellent particle has water repellency, and the surfaces of said plate forming members have hydrophilicity.

4. The printing device according to claim 1, wherein said plate forming members are photosensitive members.

5. A printing method employing a rewritable plate, comprising:

accepting and holding an ink-repellent particle on the surface of a first plate forming member in a hollow of the surface of a second plate forming member;

pushing said ink-repellent particle held by said second plate forming member into said hollow;

supplying a recording material to the surfaces of said plate forming members to form an image portion;

transferring said recording material of the surfaces of said plate forming members to an intermediate transfer member; and transferring the recording material of the surface of said intermediate transfer member to a recorded medium;

wherein the surface of said ink-repellent particle has a property of repelling said recording material, and also the surfaces of said plate forming members have a property not to repel said recording material.

6. The printing method according to claim 5, wherein said recording material is oil-based ink, the surface of said ink-repellent particle has oil repellency, and the surfaces of said plate forming members have lipophilicity.

7. The printing method according to claim 5, wherein said recording material is water-based ink, the surface of said ink-repellent particle has water repellency, and the surfaces of said plate forming members have hydrophilicity.

8. The printing method according to claim 5, wherein said plate forming members are photosensitive members.

9. The printing device according to claim 1, further comprising:

a latent image forming unit configured to form a latent image on the surface of said first plate forming member;

a protrusion forming unit configured to form a protrusion by selectively adhering an ink-repellent particle to a portion where the latent image on the surface of said first plate forming member.

10. The printing method according to claim 5, further comprising:

forming a latent image on the surface of a first plate forming member configured to form a rewritable plate;

forming a protrusion by adhering an ink-repellent particle to the surface of said first plate forming member based on said latent image.

* * * * *